US008733450B2

(12) United States Patent
Murray et al.

(10) Patent No.: US 8,733,450 B2
(45) Date of Patent: May 27, 2014

(54) TUBULAR SEATING SYSTEM AND METHOD OF SEATING A PLUG

(75) Inventors: Douglas J. Murray, Magnolia, TX (US); James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 501 days.

(21) Appl. No.: 13/099,943

(22) Filed: May 3, 2011

(65) Prior Publication Data

US 2012/0279722 A1 Nov. 8, 2012

(51) Int. Cl.
*E21B 34/14* (2006.01)
*E21B 34/06* (2006.01)

(52) U.S. Cl.
USPC ..... 166/373; 166/386; 166/318; 166/193

(58) Field of Classification Search
USPC ..... 166/373, 386, 318, 193
See application file for complete search history.

(56) References Cited

U.S. PATENT DOCUMENTS 7,637,323 B2 * 12/2009 Schasteen et al. ..... 166/318

OTHER PUBLICATIONS

S.J. Lee et al., "Characterization of laterally deformable elastomer membranes for microfluidics"; Journal of Micromechanics and Microengineering, IOP Publishing, J. Micromech, Mocroeng. 17 (Feb. 16, 2007) pp. 843-851.

Peter A. Willis et al., "Monolithic Teflon membrane valves and pumps for harsh chemical and low-temperature use"; Lab on a Chip; www.rsc.org/loc; Jul. 12, 2007, pp. 1-6.

Winkler, H.W., "Dynamic Performance Testing of Single-Element Unbalanced Gas-Lift Valves," SPE Production Engineering Journal, vol. 2, No. 3, Aug. 1987, pp. 183-190.

* cited by examiner

*Primary Examiner* — Brad Harcourt
*Assistant Examiner* — Wei Wang
(74) *Attorney, Agent, or Firm* — Cantor Colburn LLP

(57) ABSTRACT

A tubular seating system includes a seat disposed at a deformable first tubular which is sealable with a plug such that pressure is buildable thereagainst. A second tubular in operable communication with the deformable first tubular defining a support cavity therebetween is configured such that pressure within the support cavity provides support to the seat.

18 Claims, 12 Drawing Sheets

TUBULAR SEATING SYSTEM AND METHOD OF SEATING A PLUG

BACKGROUND

Tubular system operators employ methods and devices to permit actuation of tubular tools such as those in industries concerned with earth formation boreholes, such as hydrocarbon recovery and gas sequestration, for example. It is not uncommon for various operations in these industries to utilize a temporary plugging device against which to build pressure to cause an actuation. Some such systems allow plugs to be forced through a seat resulting in an undesirable surge in pressure beyond the seat in the process. Although such devices and methods work as intended the industry is always receptive to new devices and methods that allow plugging to be removed after an actuation has been completed without the mentioned drawback.

BRIEF DESCRIPTION

Disclosed herein is a tubular seating system. The system includes a seat disposed at a deformable first tubular which is sealable with a plug such that pressure is buildable thereagainst. A second tubular in operable communication with the deformable first tubular defining a support cavity therebetween is configured such that pressure within the support cavity provides support to the seat.

Further disclosed is a method of selectively seating a plug including seating a plug against a seat, building pressure against the seated plug, porting pressure built against the seated plug to a support cavity, and biasing the seat toward a position supportive of the plug with pressure in the support cavity.

Further disclosed is a tubular seating system including a seat sealingly engagable with a plug and a valving mechanism in operable communication with the seat configured to prevent passage of a plug seated thereagainst during a first pressure up event and allow passage of the plug during a second pressure up event. The pressure of the first pressure up event exceeds the pressure of the second pressure up event.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
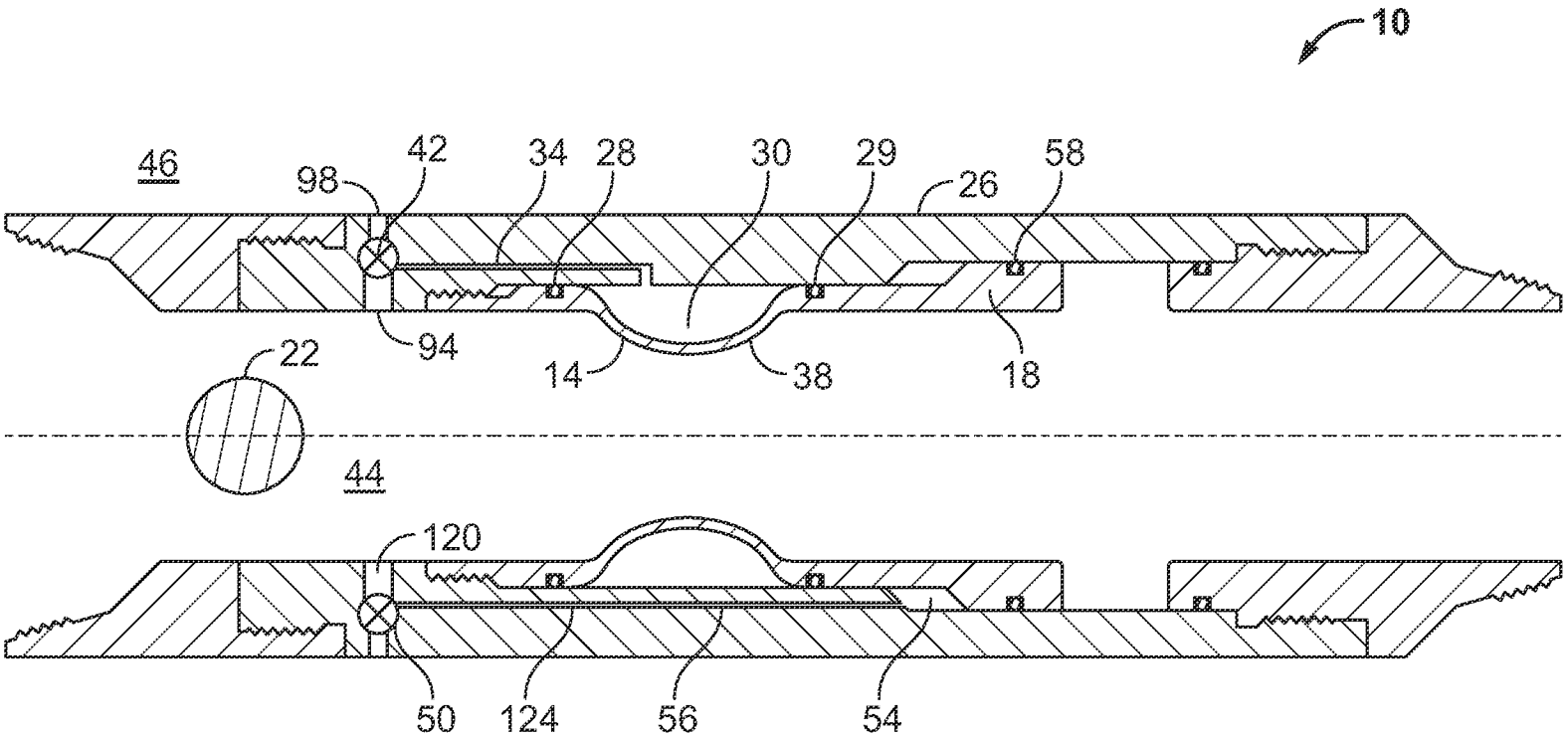
FIG. 1 depicts a cross sectional view of a tubular seating system disclosed herein illustrated with a plug in a seated position.
Figure 2:
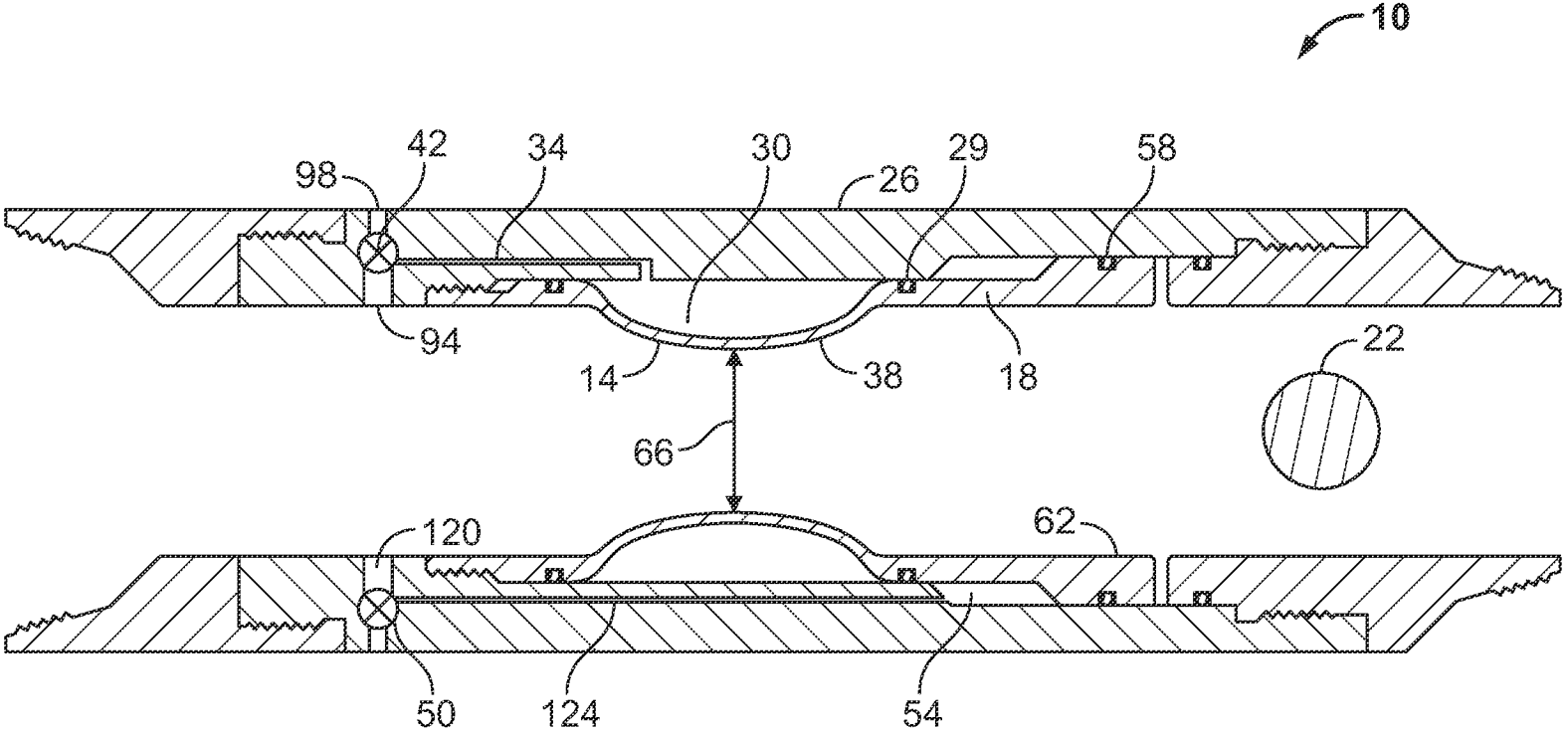
FIG. 2 depicts a cross sectional view of the tubular seating system disclosed in FIG. 1 illustrated in a position that allows a plug to pass a seat.

Referring to FIGS. 1 and 2, an embodiment of a tubular seating system disclosed herein is illustrated at 10. The tubular seating system 10 includes a seat 14 disposed at a first tubular 18 that is sealably engagable with a plug 22, illustrated herein as a ball, such that pressure can build upstream of the plug 22 when sealingly seated against the seat 14. A second tubular 26 positioned radially of the first tubular 14, with seals 28 and 29, shown herein as o-rings, define a support cavity 30 therebetween. A port 34 provides fluidic communication between the cavity 30 and a location upstream 44 of the seat 14 where pressure can build when the plug 22 is seated at the seat 14. The cavity 30 is configured to support the seat 14 in response to pressure therewithin to inhibit passage of the plug 22. In this embodiment pressure within the support cavity 30 acts directly on walls 38 of the seat 14, including radially inwardly. As such, forces from the pressure counter forces applied to the seat 14 by the plug 22 that are in a direction to deform the seat 14 to allow the plug 22 to pass.

An optional support valve 42 is actuatable at least between positions fludically connecting the cavity 30 to the location upstream 44 of the seat 14 and fludically connecting the cavity 30 to an outside 46 of both the first tubular 18 and the second tubular 26. When the support valve 42 fluidically connects the cavity 30 to the outside 46 and the pressure outside 46 is less than pressure at the location upstream 44 of the seat 14 the pressure within the cavity 30 provides less support to the seat 14. With sufficient pressure against the plug 22 sealed against the seat 14 the seat 14 is able to deform to the position shown in FIG. 2, thereby allowing the plug 22 to pass therethrough.

Another optional valve 50, referred to herein as a release valve, is actuatable at least between a position occluding fluidic connection between a release cavity 54 and the location upstream 44 of the seat 14, to a position fluidically connecting the release cavity 54 to the location upstream 44 of the seat 14. The cavity 54 is configured to bias the seat 14 toward a deformed position as illustrated in FIG. 2. In this embodiment, the cavity 54 is sealably defined between the first tubular 18 and the second tubular 26 and seals 29 and 58. A portion 62 of the first tubular 18 is positioned such that increases in pressure within the release cavity 54 urge the portion 62 toward the right (in the Figures), thereby stretching the seat 14 and increasing a radial dimension 66 thereof. Sufficient increase in the radial dimension 66 allows the plug 22 to pass through the seat 14.

Figure 3:
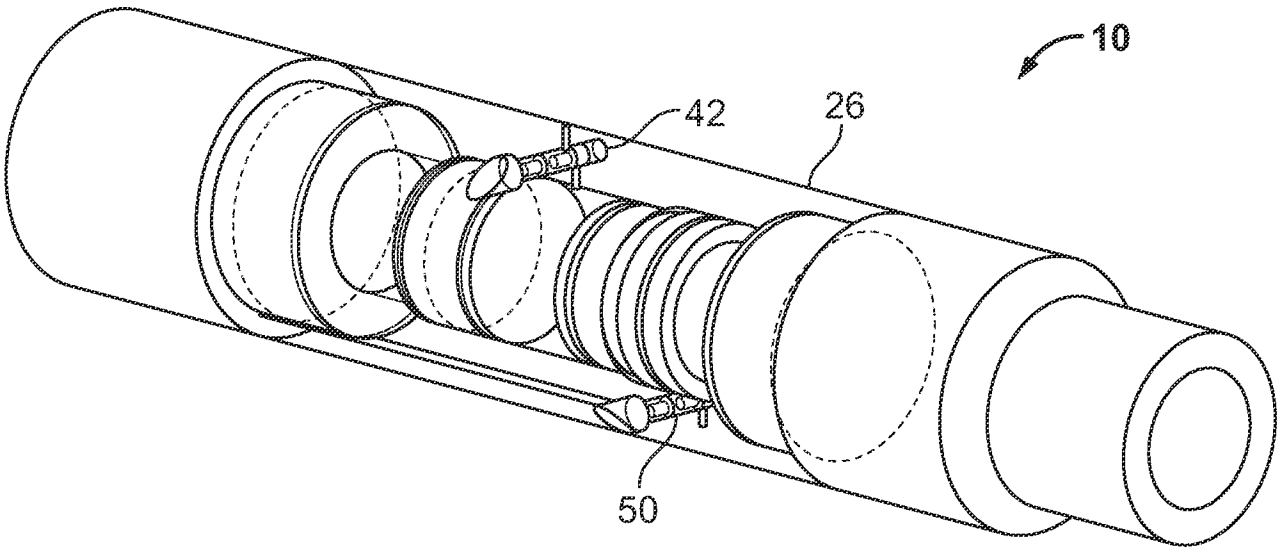
FIG. 3 depicts a perspective view of the tubular seating system of FIG. 1 with some of the components partially translucent.

In FIG. 3, an embodiment of a translucent perspective view of the seating system 10 disclosed herein is illustrated. The support valve 42 and the release valve 50 are shown housed within the second tubular 26.

Figure 4:
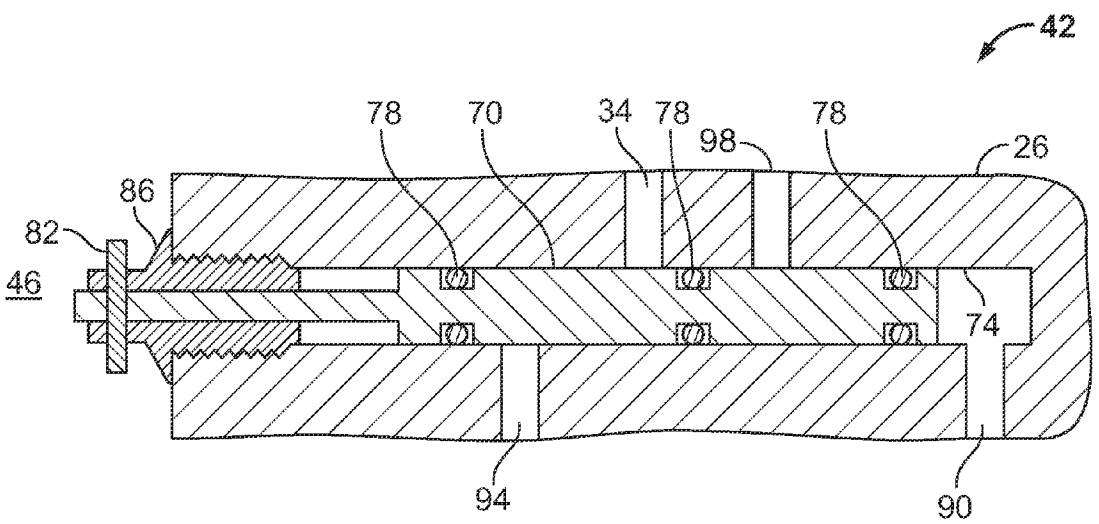
FIG. 4 depicts a cross sectional view of a support valve usable in the tubular seating system of FIG. 1 in a position wherein upstream pressure supports a seat.
Figure 5:
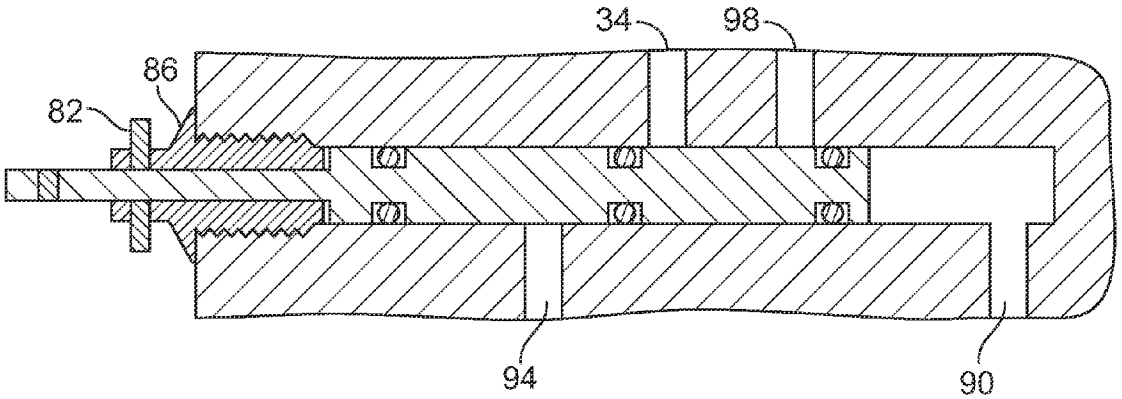
FIG. 5 depicts a cross sectional view of the support valve of FIG. 4 in a position wherein upstream pressure does not support a seat.

A cross sectional view of the support valve 42 is depicted in greater detail in FIGS. 4 and 5 in two different positions of actuation. The support valve 42 includes a mandrel 70 that is movably sealingly engaged with a bore 74 in the second tubular 26 by seals 78. A release member 82, shown herein as a shear pin, fixedly attaches the mandrel 70 to a cap 86 fixed to the second tubular 26. The release member 82 is configured to release when a selected force acts upon the mandrel 70. The force is calculated to correlate with a threshold pressure differential built up between the location upstream 44 of the seat 14 and the outside 46. The pressure differential is supplied to the mandrel 70 via ports 34, 90, 94 and 98 fluidically connected to the bore 74. Specifically, in addition to connecting to the bore 74 the ports are connected as follows: the ports 90 and 94 connect to the location upstream 44 of seat 14, the port 34 connects to the support cavity 30 and the port 98 connects to the outside 46. Since the mandrel 70 is not sealingly engaged with the cap 86, longitudinal forces on the mandrel 70 are generated by pressure differences between the port 90 and the outside 46. Or stated another way, the support valve 42 is actuated by pressure differential between the location upstream 44 of the seat 14 and the outside 46 of both tubulars 18, 26.

The foregoing structure allows the support valve 42 to provide fluidic communication between the location upstream 44 and the support cavity 30 when in the initial position as shown in FIG. 4 through the ports 34 and 94. After actuation of the support valve 42, as shown in FIG. 5, the cavity 30 is in fluidic communication with the outside 46 through the ports 34 and 98.

Figure 6:
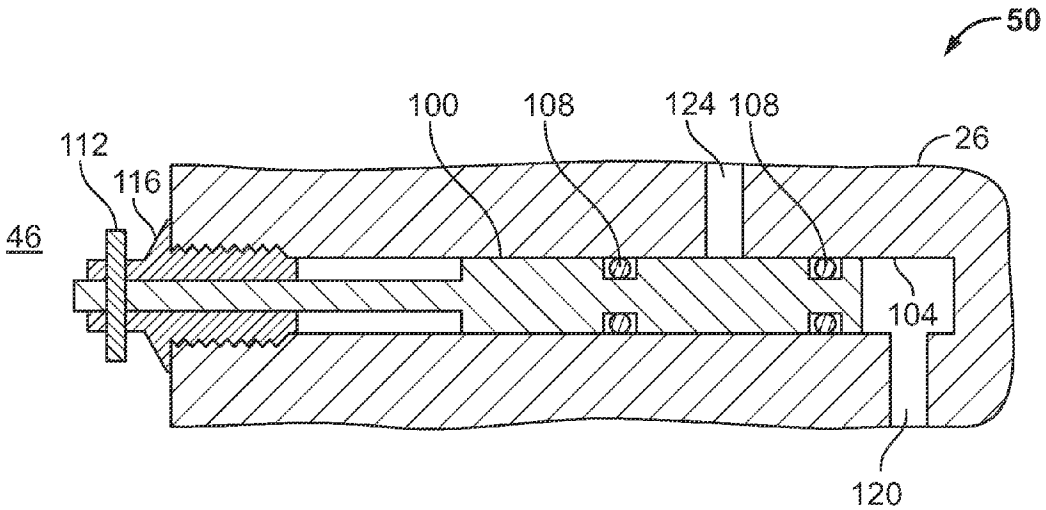
FIG. 6 depicts a cross sectional view of a release valve usable in the tubular seating system of FIG. 1 in a position wherein upstream pressure is not ported to release a seat.
Figure 7:
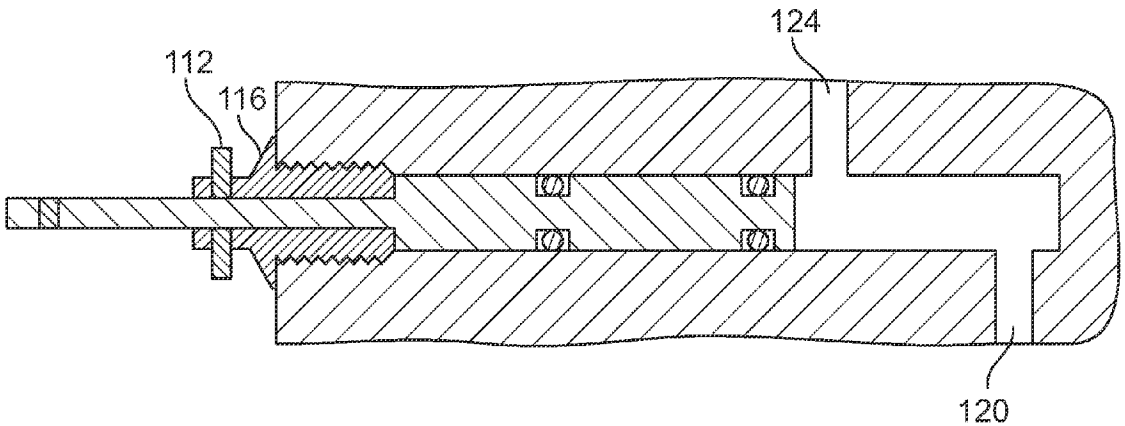
FIG. 7 depicts a cross sectional view of the release valve of FIG. 6 in a position wherein upstream pressure is ported to release a seat.

A cross sectional view of the release valve 50 is depicted in FIGS. 6 and 7 in two different positions of actuation. The release valve 50 includes a mandrel 100 that is movably sealingly engaged with a bore 104 in the second tubular 26 by seals 108. A release member 112, shown herein as a shear pin, fixedly attaches the mandrel 100 to a cap 116 fixed to the second tubular 26. The release member 112 is configured to release when a selected force acts upon the mandrel 100. The force is calculated to correlate with a threshold pressure differential built up between the location upstream 44 of the seat 14 and the outside 46. The pressure differential is supplied to the mandrel 100 via port 120 connected to the bore 104. Specifically, in addition to connecting to the bore 104 the port 120 and another port 124 are connected as follows: the port 120 connects to the location upstream 44 of seat 14, and the port 124 connects to the release cavity 54. Since the mandrel 100 is not sealingly engaged with the cap 116, longitudinal forces on the mandrel 100 are generated by pressure differences between the port 120 and the outside 46. Or stated another way, the release valve 50 is actuated by pressure differential between the location upstream 44 of the seat 14 and the outside 46 of both tubulars 18, 26.

The foregoing structure permits the release valve 50 to occlude fluidic communication between the location upstream 44 and the release cavity 54 when in the initial position as shown in FIG. 6. After actuation of the release valve 50, as shown in FIG. 7, the release cavity 54 is in fluidic communication with the location upstream 44 of the seat 14 through the ports 120 and 124. In this position, as discussed earlier, pressure at the location upstream 44 acts within the release cavity 54 to urge the seat 14 to deform to allow passage of the plug 22.

Figure 8:
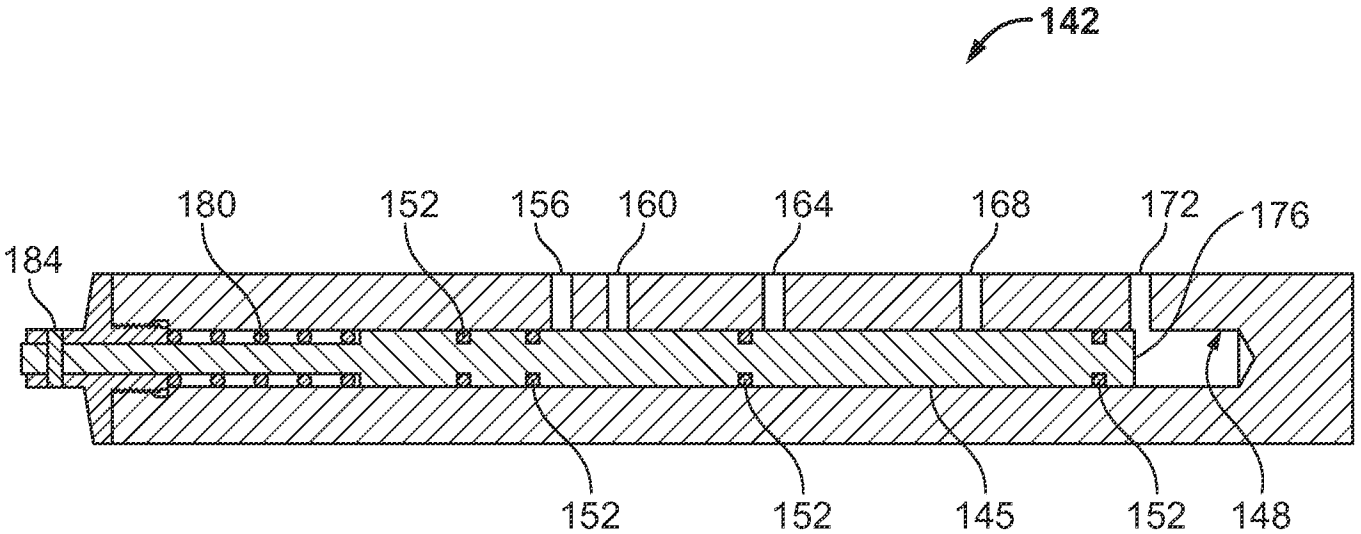
FIG. 8 depicts a cross sectional view of a combination support valve and release valve usable in the tubular seating system disclosed in a run in position.
Figure 9:
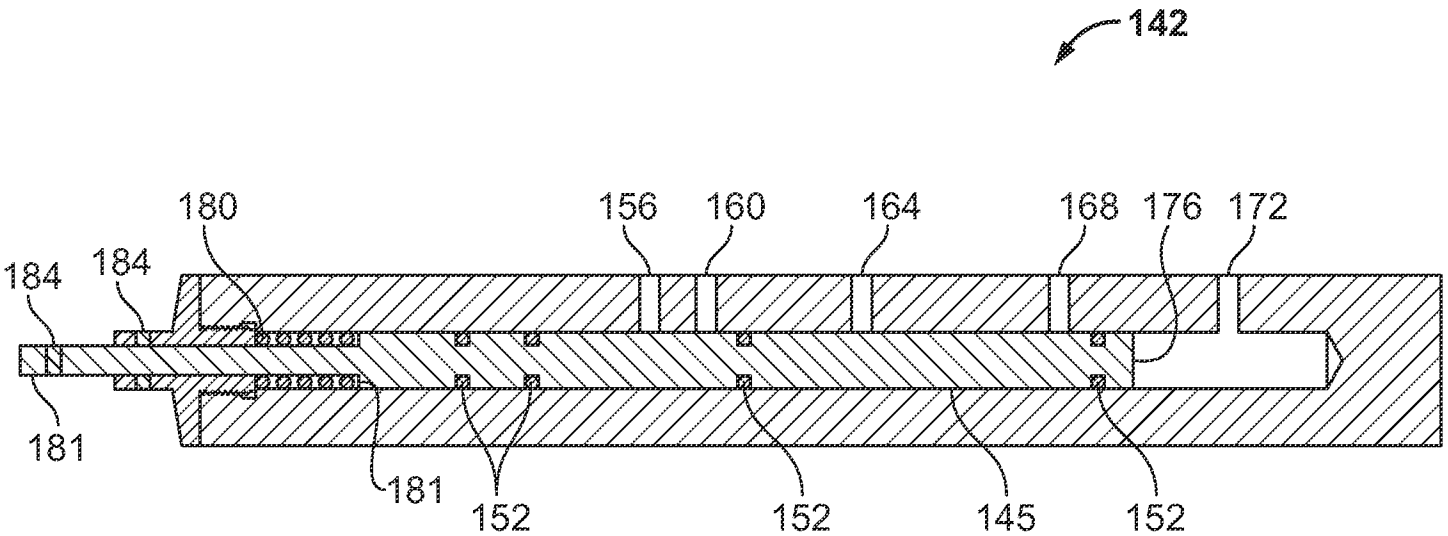
FIG. 9 depicts a cross sectional view of the combination support valve and release valve of FIG. 8 in a activated position.
Figure 10:
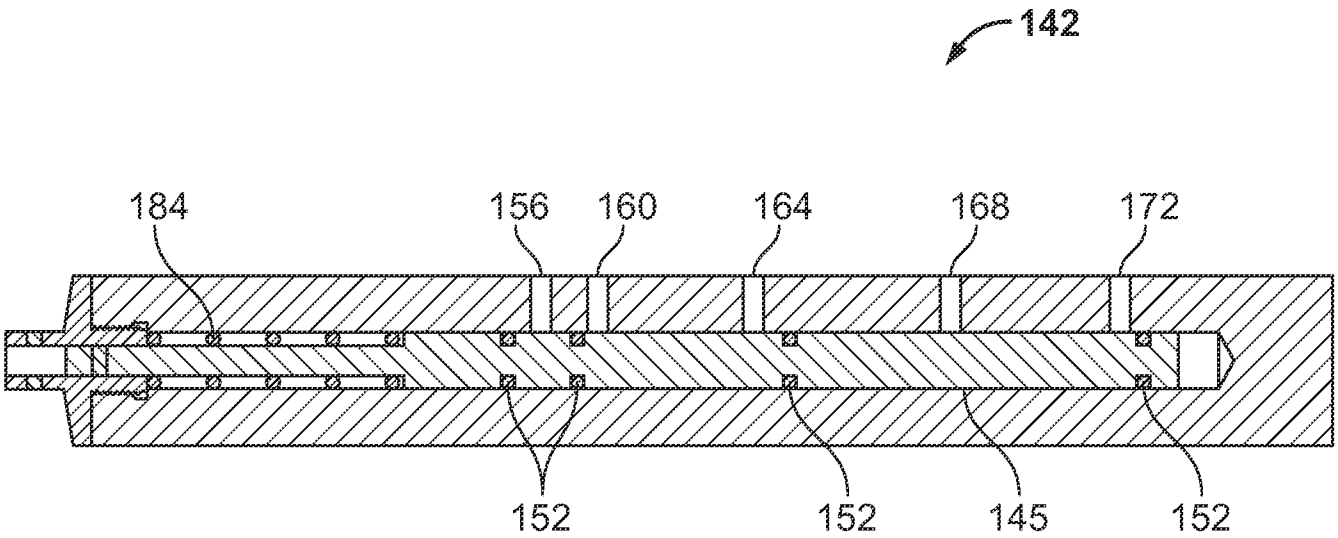
FIG. 10 depicts a cross sectional view of the combination support valve and release valve of FIG. 8 in a pump through position.

Referring to FIGS. 8-10, an alternate embodiment of the seating system 10 disclosed herein includes a combined support and release valve 142. The valve 142 incorporates the functions of both the support valve 42 and the release valve 50 into a single assembly with one movable mandrel 145. Seals 152 movably seal the mandrel 145 to a borehole 148. Positions of the seals 152 relative to a plurality of ports 156, 160, 164, 168 and 172 control fluidic communication between the ports 156, 160, 164, 168, 172 as follows.

In FIG. 8 the valve 142 is shown in a "run in" position. In this position the ports 156 and 172 are both fluidically connected to the location upstream 44 of the seat 14 such that pressure built at the location upstream 44 acts on an end 176 of the mandrel 145 urging it in a direction (leftward in the Figures) against a biasing force of a biasing member 180, illustrated herein as a compression spring. The port 160 is connected to the location upstream 44 of the seat 14 and, via port 156, to the support cavity 30, and thereby allows pressure from the location upstream 44 to support the seat 14. The port 164 connects to the outside 46 and the port 168 connects to the release cavity 54. Since the ports 164 and 168 are connected together by the valve 142 in the run in position, the release cavity is in communication with the outside 46 and not with the pressure at the location upstream 44 of the seat 14. In this position high pressures can build against the plugged seat 14 since the support cavity 30 is supported by pressure from the location upstream 44 while the release cavity 54 is not supplied with this high pressure. This pressure can be used to actuate an actuator or other downhole device.

Referring to FIG. 9, at a selected pressure a release member 184, shown as a shear pin, is sheared due to forces generated by differences in pressure acting on the end 176 versus pressure acting on an end 181, opposite the end 180 of the mandrel 145 and forces generated by the biasing member 180. Although the shear pin 184 has sheared and the mandrel 145 has moved, to an "activated" position, the seals 152 have remained in their same locations relative to the ports 156, 160, 164, 168, 172. As such, no valving changes have yet to take place.

Referring to FIG. 10, in response to a sufficient drop in pressure at the location upstream 44, the biasing force of the biasing member 180 is sufficient to move the mandrel 145 (to the right in the Figures) to a "pump through" position. The valve 142 has shifted in the pump through position such that the support cavity 30 is now connected to the outside 46 through fluidic communication of the port 160 with the port 164. Additionally, the release cavity 54 is now connected to pressure of the location upstream 44 via the fluidic connection of the port 168 with the port 172. As pressure at the location upstream 44 builds with the valve 142 in this pump through position pressure within the release cavity 54 builds while pressure within the support cavity 30 does not (since it is connected to the outside 46). Thus, the seat 14 will be deformed until the plug 22 can pass through the seat 14.

It should be appreciated that the release cavity 54 can be sized and configured to create forces sufficient to deform the seat 14 at relatively low pressures. For example, the tubular seating system 10 could be configured to maintain pressures in excess of 5,000 psi prior to actuation of the release valve 50 while permitting passage of the plug 22 at pressures less than 500 psi subsequent actuation of the release valve 50. Further, pressures to cause actuation of the release valve 50 can be at least ten times greater than pressures to deform the seat 14. By allowing passage of the plug 22 at such a low pressure the disclosed system 10 greatly reduces a surge in pressure beyond a seat that is common in typical systems that is caused by the sudden increase in pressure downstream of the seat that occurs when a plug is forced through a seat at high pressure.

Figure 11:
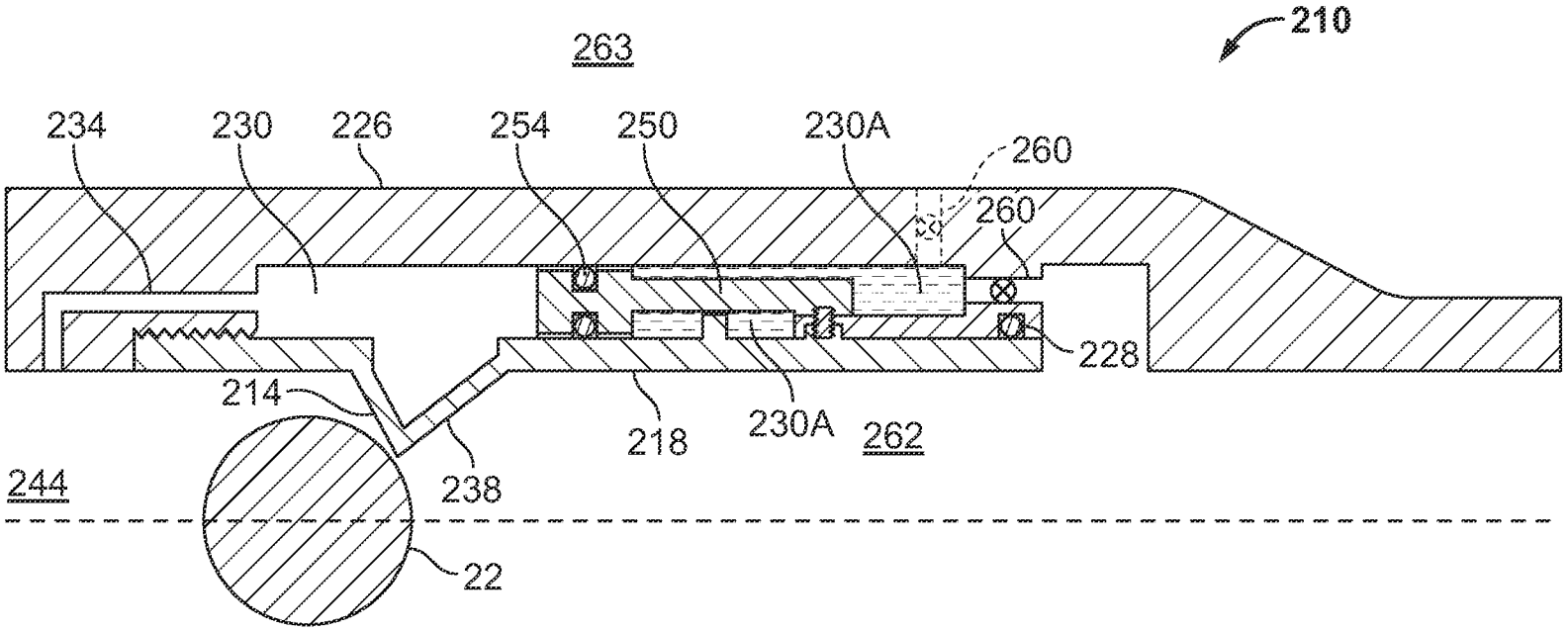
FIG. 11 depicts a partial cross sectional view of an alternate embodiment of a tubular seating system disclosed herein.

Referring to FIG. 11, an alternate embodiment of a seating system disclose herein is illustrated at 210. The seating system 210 includes, a seat 214 disposed at a first tubular 218 that is sealingly engagable with the plug 22 such that pressure can build upstream of the plug 22 when sealingly seated against the seat 214. A second tubular 226 positioned radially of the first tubular 214, with a seal 228, shown herein as an o-ring, at the other end of the first tubular 218. A cavity 230 is defined between the first tubular 218, the second tubular 226 the threadable engagement and the seal 228. A port 234 provides fluidic communication between the cavity 230 and a location upstream 244 of the seat 214. The cavity 230 is configured to provide support to the seat 214 in response to pressure therewithin to inhibit passage of the plug 22. In this embodiment pressure within the cavity 230 acts directly on walls 238 of the seat 214, including radially inwardly. And a piston 250 is slidably sealingly engaged within the cavity 230 by seals 254, illustrated as o-rings, that sealably separates a portion 230A of the cavity 230.

Figure 12:
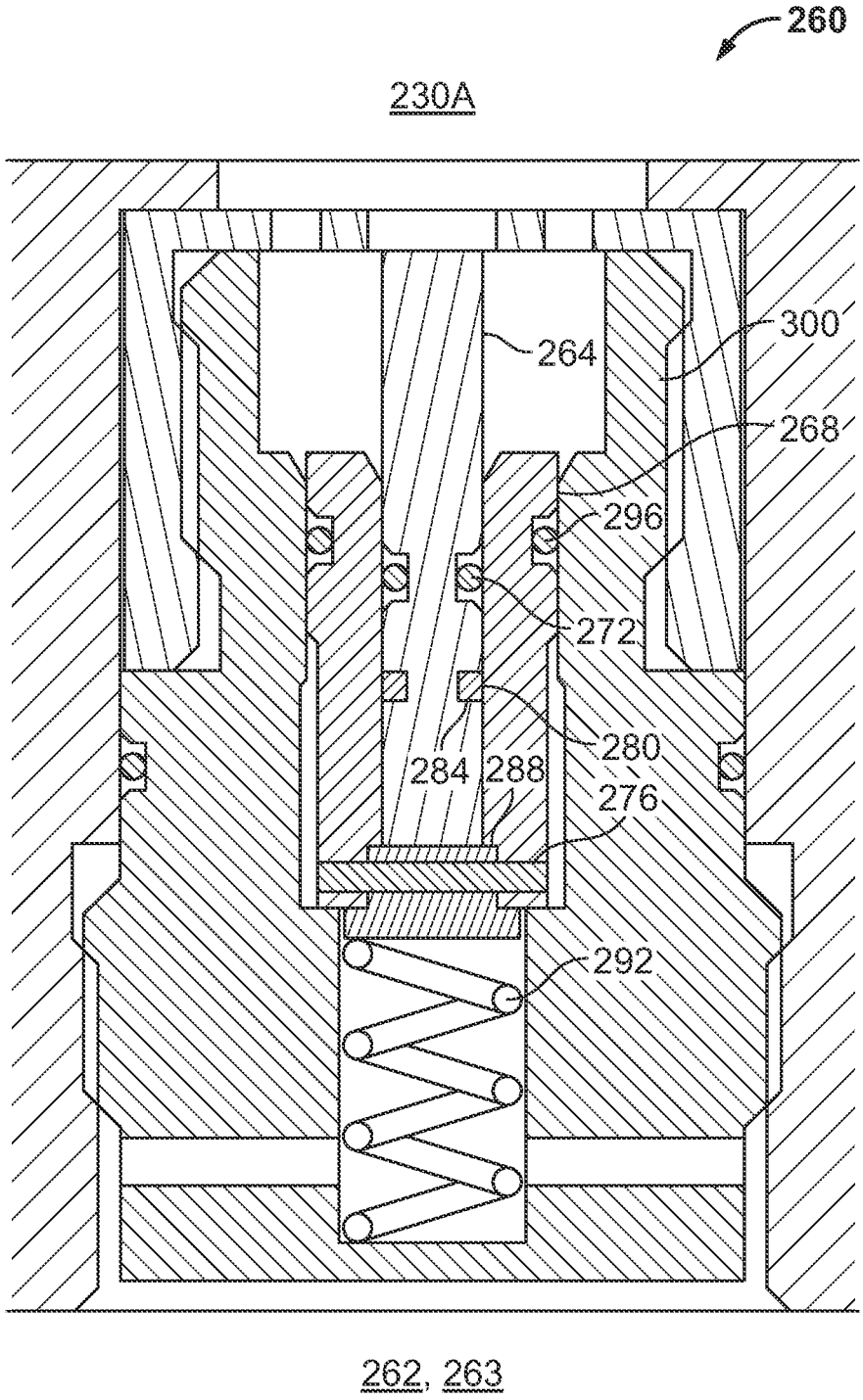
FIG. 12 depicts a cross sectional view of a valve used in the tubular seating system of FIG. 11 in a run in position.
Figure 13:
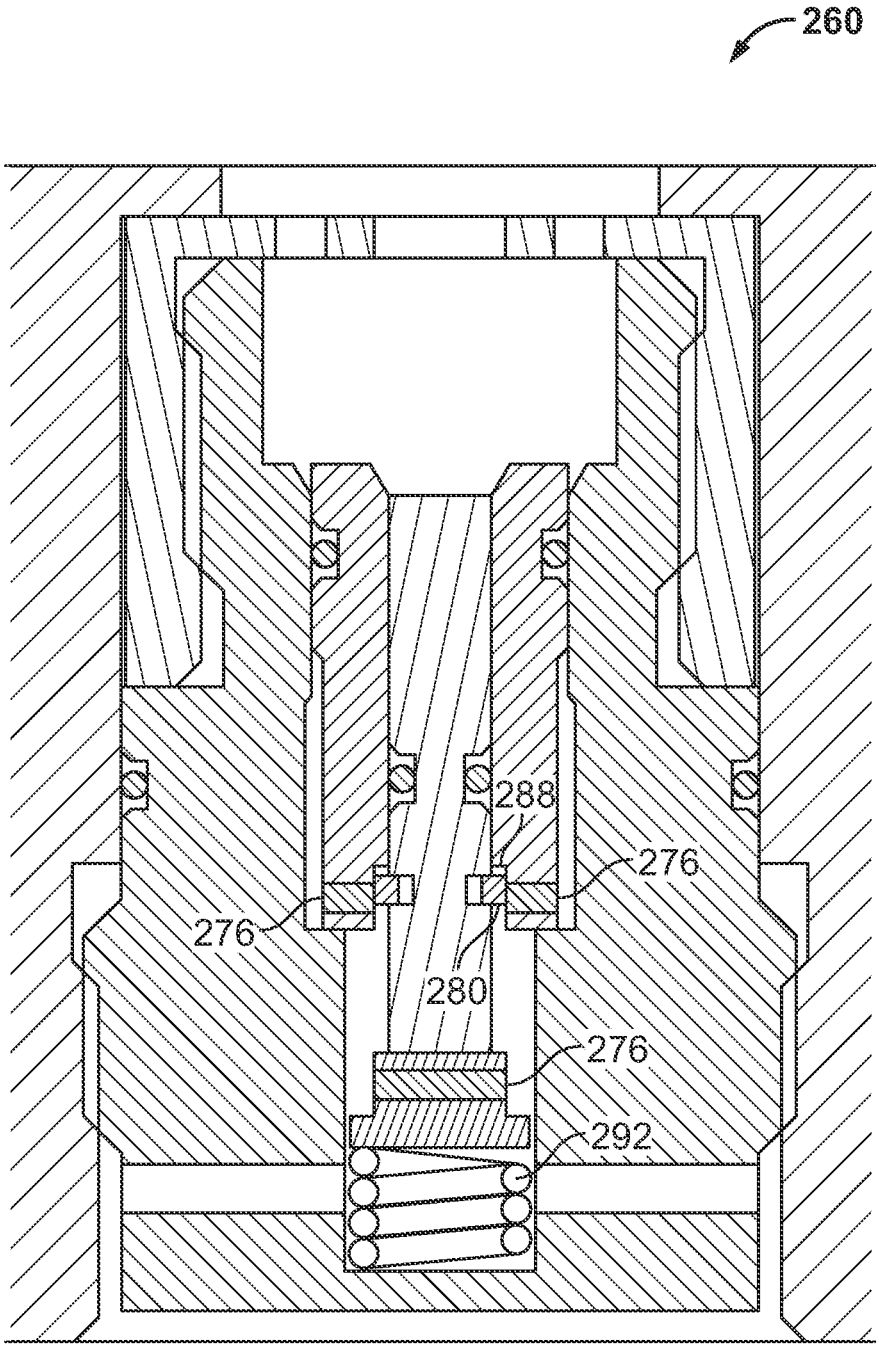
FIG. 13 depicts a cross sectional view of the valve of FIG. 12 in an activated position.
Figure 14:
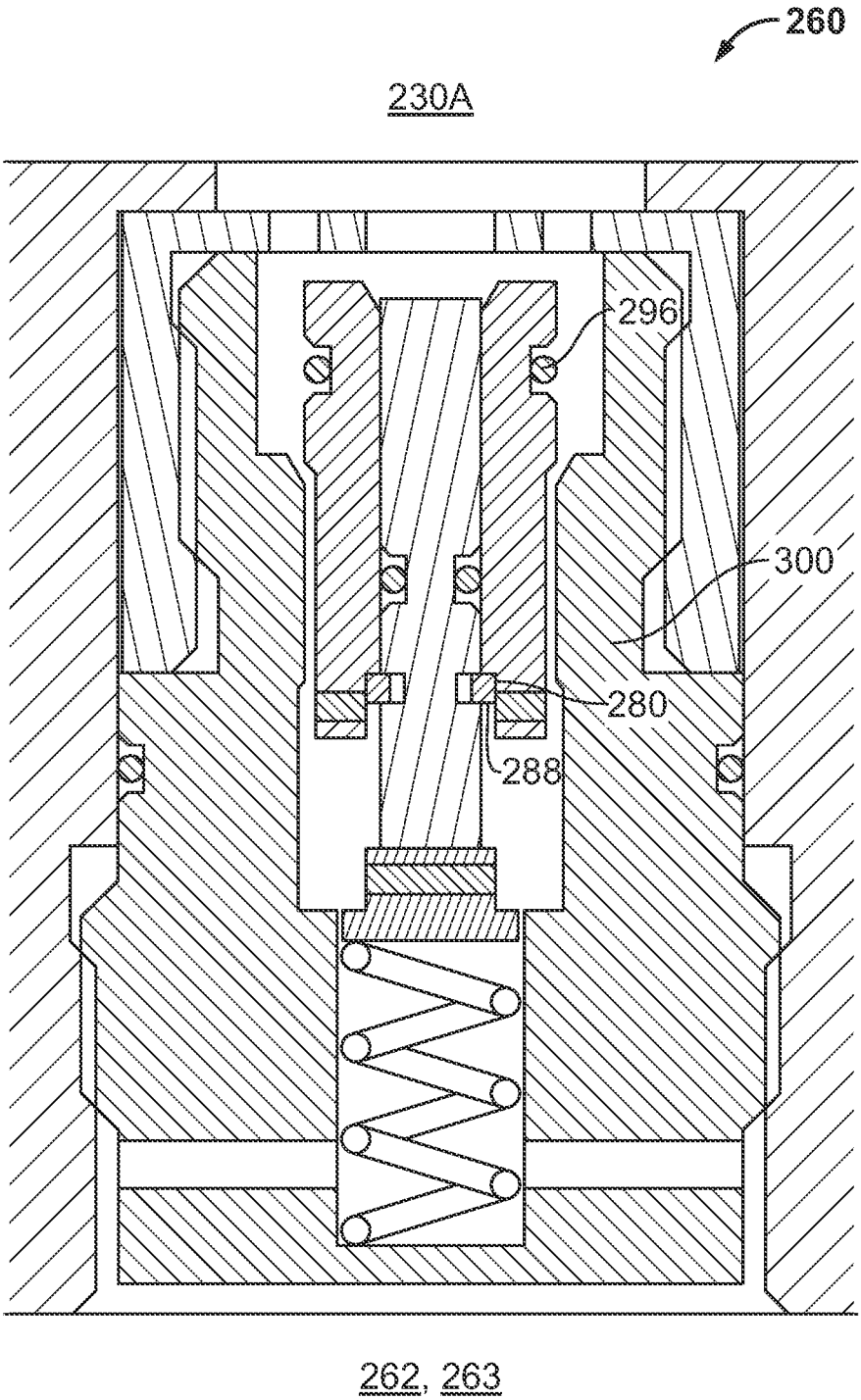
FIG. 14 depicts a cross sectional view of the valve of FIG. 12 in a pump through position.

Referring to FIGS. 12-14, a valve 260 is in fluidic communication with the portion 230A and either a location 262 downstream of the seat 214 or an outside 263 of the tubulars 218, 226. The valve 260 is illustrated in a run in position (FIG. 12), in an activated position (FIG. 13), and in a pump through position (FIG. 14). The valve 260 is closed to fluid flow therethrough while in either the run in position or the activated position while it permits fluid flow therethrough when in the pump through position. The valve 260 includes, a first piston 264 sealingly slidably engaged within a second piston 268 by a seal 272. A release device 276, illustrated herein as a shear pin, locks the first piston 264 to the second piston 268. A pressure differential across the valve 260 that exceeds a selected threshold shears the shear pin 276 and allows the first piston 264 to move relative to the second piston 268. Upon a selected amount of movement between the pistons 264, 268 an engagement device 280, illustrated as a snap ring, engaged within an annular groove 284 in the first piston 264 engages with a shoulder 288 of the second piston 268 (FIG. 13). This engagement causes both pistons 264, 268 to move together under a biasing load applied to the pistons 264, 268 by a biasing member 292, illustrated herein as a compression spring, when a pressure differential across the valve 260 drops below a selected threshold level.

Movement of the pistons 264, 268 a selected dimension results in disengagement of a seal 296 that slidably sealingly engages the second piston 268 to a housing 300 prior to such movement (FIG. 14). The disengagement of the seal 296 allows fluid to flow through the valve 260. This fluid flow permits fluid to exit the portion 230A thereby allowing the piston 250 to move when pressure at the location 244 upstream is greater than the located downstream 262 or at the outside 263 of the tubulars 218, 226. This movement of the piston 50 causes the seat 214 to increase in radial dimensions until the plug 22 can pass thereby.

The foregoing structure allows an operator to pressure up to a first pressure to perform a downhole operation and then to relieve the pressure before pressuring up to a second pressure to pump the plug 22 through the seat 214. Parameters of the valving system 210 regarding the seat 214 and the piston 250, for example, can be adjusted to cause the first pressure to be significantly greater than the second pressure, including by more than a factor of ten.

Optionally, the portion 230A of the cavity 230 may be filled with a fluid, such as an incompressible fluid, prior to operating the valve 210 to prevent the piston 250 from moving in advance of opening of the valve 260.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A tubular seating system comprising:

a seat disposed at a deformable first tubular being sealable with a plug such that pressure is buildable thereagainst;

a second tubular in operable communication with the deformable first tubular defining a support cavity therebetween being configured such that pressure within the support cavity provides support to the seat; and a support valve in operable communication with the support cavity configured to control porting of fluidic communication between the support cavity and a location upstream of the seat.

2. The tubular seating system of claim 1, wherein the support valve is actuatably responsive to a selected threshold pressure differential being reached between the location upstream of the seat when plugged and pressure outside of both the deformable first tubular and the second tubular.

3. The tubular seating system of claim 1, wherein the support valve is configured to port the support cavity to a location outside of both the deformable first tubular and the second tubular subsequent actuation of the support valve.

4. The tubular seating system of claim 1, wherein the seat is configured to deform to allow the plug to pass when pressure within the support cavity is less than pressure upstream of the seat when plugged.

5. A tubular seating system comprising:

a seat disposed at a deformable first tubular being sealable with a plug such that pressure is buildable thereagainst;

a second tubular in operable communication with the deformable first tubular defining a support cavity therebetween being configured such that pressure within the support cavity provides support to the seat; and a release valve in operable communication with a release cavity being configured to control porting between the release cavity and a location upstream of the seat.

6. The tubular seating system of claim 5, wherein pressure built within the release cavity urges the seat toward a deformed configuration wherein the plug can pass the seat.

7. The tubular seating system of claim 5, wherein a support valve and the release valve share a single movable mandrel.

8. The tubular seating system of claim 5, wherein the release valve is configured to fluidically connect the release cavity to a location upstream of the seat in response to a drop in pressure against the seat while plugged.

9. The tubular seating system of claim 5, wherein the release valve is actuatably responsive to a selected threshold pressure differential being reached between the location upstream of the seat when plugged and pressure outside of both the deformable first tubular and the second tubular.

10. A method of selectively seating a plug comprising:

seating a plug against a seat;

building pressure against the seated plug;

porting pressure built against the seated plug to a support cavity;

biasing the seat toward a position supportive of the plug with pressure in the support cavity;

actuating a support valve;

occuluding pressure against the seated plug from reaching the support cavity;

deforming the seat; and allowing the plug to pass the seat.

11. The method of selectively seating the plug of claim 10, wherein the actuating the support valve includes fluidically disconnecting the support cavity from pressure upstream of the seated plug.

12. The method of selectively seating the plug of claim 10, wherein the actuating the support valve includes fluidically connecting the support cavity to an outside of both a first tubular and a second tubular defining the support cavity.

13. The method of selectively seating the plug of claim 10, wherein biasing the seat includes radially supporting at least a portion of the seat.

14. The method of selectively seating the plug of claim 10, further comprising:

actuating a release valve;

porting pressure upstream of the seated plug to a release cavity; and biasing the seat toward a position that allows the plug to pass thereby.

15. The method of selectively seating the plug of claim 14, wherein biasing the seat toward a position that allows the plug to pass includes longitudinally biasing the seat.

16. The method of selectively seating the plug of claim 10, further comprising:

actuating a release valve;

deforming the seat; and passing the plug by the seat.

17. The method of selectively seating the plug of claim 16, further comprising deforming the seat with pressure below 500 psi.

18. The method of selectively seating the plug of claim 16, wherein pressure required for actuating the release valve is at least a factor of ten greater than the pressure required for deforming the seat.

* * * * *